US007407525B2

(12) United States Patent
Liang

(10) Patent No.: US 7,407,525 B2
(45) **Date of Patent: *Aug. 5, 2008**

(54) FRACTURE AND WEAR RESISTANT COMPOUNDS AND DOWN HOLE CUTTING TOOLS

(75) Inventor: Dah-Ben Liang, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 508 days.

This patent is subject to a terminal disclaimer.

(21) Appl. No.: 10/700,693

(22) Filed: Nov. 4, 2003

(65) Prior Publication Data

US 2004/0140133 A1 Jul. 22, 2004

Related U.S. Application Data

(63) Continuation-in-part of application No. 10/437,750, filed on May 14, 2003, now Pat. No. 7,017,677, and a continuation-in-part of application No. 10/396,261, filed on Mar. 25, 2003, now Pat. No. 7,036,614, and a continuation-in-part of application No. 10/017,404, filed on Dec. 14, 2001, now Pat. No. 6,655,478.

(60) Provisional application No. 60/398,374, filed on Jul. 24, 2002.

(51) Int. Cl.
*C22C 29/00* (2006.01)
*C22C 29/08* (2006.01)
*E21B 10/36* (2006.01)

(52) U.S. Cl. ..... 75/240; 75/242; 51/309; 175/336; 175/374; 175/425; 175/428

(58) Field of Classification Search ..... 75/240, 75/242; 175/336, 374, 425, 428; 51/309
See application file for complete search history.

(56) References Cited

U.S. PATENT DOCUMENTS

| | | | | |
|---|---|---|---|---|
| 4,017,480 | A | 4/1977 | Baum | |
| 4,327,156 | A | 4/1982 | Dillion et al. | |
| 4,341,557 | A | 7/1982 | Lizenby | |
| 4,368,788 | A | 1/1983 | Drake | |
| 4,372,404 | A | 2/1983 | Drake | |
| 4,398,952 | A | 8/1983 | Drake | |
| 4,428,906 | A | 1/1984 | Rozmus | |
| 4,455,354 | A | 6/1984 | Dillion et al. | |
| 4,608,318 | A | 8/1986 | Makrides et al. | |
| 4,656,002 | A | 4/1987 | Lizenby et al. | |
| 4,673,549 | A | 6/1987 | Ecer | |
| 4,696,352 | A * | 9/1987 | Buljan et al. | 175/57 |
| 4,723,996 | A | 2/1988 | Brunet et al. | |
| 4,744,943 | A | 5/1988 | Timm | |
| 4,859,543 | A | 8/1989 | Greenfield et al. | |
| 4,945,073 | A | 7/1990 | Dubensky et al. | |
| 5,089,182 | A | 2/1992 | Findeisen et al. | |
| 5,290,507 | A | 3/1994 | Runkle | |
| 5,358,545 | A | 10/1994 | Nagro | |
| 5,423,899 | A | 6/1995 | Krall et al. | |
| 5,441,693 | A | 8/1995 | Ederyd et al. | |
| 5,476,531 | A | 12/1995 | Timm et al. | |
| 5,563,107 | A | 10/1996 | Dubensky et al. | |
| 5,593,474 | A | 1/1997 | Keshavan et al. | |
| 5,653,299 | A | 8/1997 | Sreshta et al. | |
| 5,762,843 | A | 6/1998 | Messa et al. | |
| 5,880,382 | A * | 3/1999 | Fang et al. | 75/236 |
| 5,891,522 | A | 4/1999 | Olson | |
| 5,967,245 | A | 10/1999 | Garcia et al. | |
| 6,063,502 | A | 5/2000 | Sue et al. | |
| 6,106,957 | A | 8/2000 | Fang | |
| 6,126,709 | A * | 10/2000 | Åkerman et al. | 75/240 |
| 6,197,084 | B1 * | 3/2001 | Liang | 75/240 |
| 6,220,375 | B1 | 4/2001 | Butcher et al. | |
| 6,244,364 | B1 | 6/2001 | Cariveau et al. | |
| 6,290,008 | B1 | 9/2001 | Portwood et al. | |
| 6,319,460 | B1 | 11/2001 | Fang | |
| 6,365,230 | B1 | 4/2002 | Baik et al. | |
| 6,478,887 | B1 | 11/2002 | Sue et al. | |
| 6,571,889 | B2 | 6/2003 | Griffo et al. | |
| 6,655,478 | B2 * | 12/2003 | Liang et al. | 175/374 |
| 6,660,329 | B2 | 12/2003 | Liu et al. | |
| 7,258,177 | B2 * | 8/2007 | Liang et al. | 175/374 |

* cited by examiner

*Primary Examiner*—Roy King
*Assistant Examiner*—Ngoclan T Mai
(74) *Attorney, Agent, or Firm*—Y. Renee Alsandor

(57) ABSTRACT

Fracture and wear resistant cutting elements are provided. Examples include a cutting element formed of a wear resistant material having a binder composition and a coarse grain size such that the portion of the cutting element formed of the wear resistant material has a fracture toughness of at least about 18 ksi(in)$^{0.5}$ and a wear number of at least about 1.8. In a particular example, the wear resistant material has a fracture toughness of at least about 20 ksi(in)$^{0.5}$. A down hole cutting tool incorporating such cutting elements is also provided.

37 Claims, 12 Drawing Sheets

| | |
|---|---|
| STDEV | 3.93 |
| average | 9.2 |
| Max | 20.0 |
| Min | 2.7 |
| median | 8.7 |

10 series Coarse Carbide Grade & Hardness Specification

| Grade | Relative carbide particle size number (micron) | Co binder content (weight %) | Nominal Hardness (Ra) ± 0.4 |
|---|---|---|---|
| 1016 | 10 | 16 | 83.2 |
| 1014 | 10 | 14 | 83.8 |
| 1012 | 10 | 12 | 84.4 |
| 1010 | 10 | 10 | 85.0 |
| 1008 | 10 | 8 | 85.6 |
| 1006 | 10 | 6 | 86.2 |

FIG. 5

FRACTURE AND WEAR RESISTANT COMPOUNDS AND DOWN HOLE CUTTING TOOLS

CROSS-REFERENCE TO RELATED APPLICATIONS

This application claims the benefit under 35 U.S.C. § 120 as a continuation-in-part of U.S. application Ser. No. 10/017,404, now U.S. Pat. No. 6,655,478, filed Dec. 14, 2001, of U.S. application Ser. No. 10/396,261, now U.S. Pat. No. 7,036,614, filed Mar. 25, 2003, and of U.S. application Ser. No. 10/437,750, now U.S. Pat. No. 7,017,677, filed May 14, 2003, which are all incorporated herein by reference in their entireties. This application also claims the benefit of U.S. Provisional Application No. 60/398,374, filed Jul. 24, 2002, which is also incorporated herein by reference.

STATEMENT REGARDING FEDERALLY SPONSORED RESEARCH OR DEVELOPMENT

Not applicable.

BACKGROUND OF INVENTION

1. Field of the Invention

The present invention generally relates to fracture and wear resistant cutting elements for down hole cutting tools. More specifically, the invention relates to composite materials for cutting elements used on down hole cutting tools, such as rock bits, which enhance the useful life of the tools incorporating the same.

2. Background Art

Drill bits used to drill wellbores through earth formations generally can be categorized within one of two broad categories of bit structures. Drill bits in the first category are generally known as "fixed cutter" or "drag" bits, which usually include a bit body formed from steel or another high strength material and a plurality of cutting elements disposed at selected positions about the bit body. The cutting elements are typically referred to as "shear cutters" and may be formed from any one or combination of hard or superhard materials, including, for example, natural or synthetic diamond, boron nitride, and tungsten carbide.

Drill bits of the second category are typically referred to as "roller cone" bits, which include a bit body having one or more roller cones rotatably mounted to the bit body. The bit body is typically formed from steel or another high strength material. The roller cones are also typically formed from steel or other high strength material and include a plurality of cutting elements disposed at selected positions about the cones. The cutting elements may be formed from the same base material as is the cone. These bits are typically referred to as "milled tooth" bits. Other roller cone bits may include "inserts" as cutting elements, which are press fit (i.e., interference fit) into holes formed and/or machined into the roller cones. The inserts may be formed from, for example, tungsten carbide, natural or synthetic diamond, boron nitride, or any one or combination of hard or superhard materials.

Breakage or wear of cutting elements, among other factors, limits the longevity of a drill bit. For example, cutting elements used with a rock bit are generally subjected to high wear loads from contact with a borehole wall, as well as high stresses due to bending and impact loads from contact with a borehole bottom. The high wear loads can also cause thermal fatigue in the cutting elements, which initiates surface cracks on the cutting elements. These cracks are further propagated by a mechanical fatigue mechanism that is caused by the cyclical bending stresses and/or impact loads applied to the cutting elements. Fatigue cracks may result in chipping, breakage and failure of cutting elements.

Cutting elements, such as gage inserts on a roller cone bit which primarily function to cut the corner of a borehole bottom are subject to a significant amount of thermal fatigue. This thermal fatigue is caused by heat generated on the gage side of an insert by friction when the insert engages the borehole wall and slides into a bottom-most crushing position. When the insert rotates away from the bottom, it is quickly cooled by the surrounding circulating fluid. Repetitive heating and cooling of the insert initiates cracking on the outer surface of the insert. Thermal fatigue cracks then propagate through the body of the insert when the crest of the insert contacts the borehole bottom because of the high contact stresses. The time required to progress from heat checking, to chipping, and eventually to broken inserts depends upon the insert material, formation type, rotational speed of their bit, and applied weight on bit, among other factors.

In the case of roller cone bits, even inserts on interior rows are also subject to thermal fatigue caused by scraping the borehole bottom. The amount of scraping varies from row to row and is influenced by bit offset and cone to bit speed ratio, among other factors.

In the case of fixed cutter bits, the shear cutters typically have a body (or substrate), which has a contact face. An ultra hard layer is typically bonded to the contact face of the body by a sintering process to form a cutting face (sometimes referred to as a "cutting table"). The body is typically made of tungsten carbide-cobalt (sometimes referred to simply as "tungsten carbide" or "carbide"). The ultrahard material layer is typically polycrystalline ultrahard material, such as polycrystalline diamond ("PCD") or polycrystalline cubic boron nitride ("PCBN"). Typically, shear cutters are mounted into a fixed cutter bit body at a negative rake angle. Consequently, the region of the cutting element that makes contact with the earthen formation includes a portion of the ultrahard material layer's upper surface circumferential edge. This portion of the layer is subjected to the highest impact loads and thermal stresses which can result in cracks initiated at the ultrahard material layer. These cracks can propagate into the substrate of the shear cutter. Accordingly, the toughness of the substrate plays a significant role on the brakeage resistance of cutting elements for fixed cutter bits.

Cemented tungsten carbide generally refers to tungsten carbide (WC) particles dispersed in a binder metal matrix, such as iron, nickel, or cobalt. Tungsten carbide in a cobalt matrix is the most common form of cemented tungsten carbide, which is further classified by grades based on the grain size of WC and the cobalt content.

Tungsten carbide cutting elements (inserts or cutters) are primarily made in consideration of two factors that relate to the lifetime of a cutting element: wear resistance and toughness. As a result, existing inserts and shear cutters are generally formed of cemented tungsten carbide particles with average grain sizes of less than 3 μm (micrometers) as measured by ASTM E-112 method and cobalt contents in the range of 6-16% by weight of cobalt. Resulting cutting elements typically have a hardness in the range of about 86 Ra to 89 Ra.

For tungsten carbide/cobalt (WC/Co) systems, it is typically observed that wear resistance increases and fracture toughness decreases as the grain size of tungsten carbide or the cobalt content decreases. On the other hand, fracture toughness generally increases and wear resistance decreases with larger grains of tungsten carbide and/or greater percentages of cobalt. Thus, fracture toughness and wear resistance (i.e., hardness) tend to be inversely related. That is, as the grain size or the cobalt content is decreased, wear resistance of a specimen is improved, and its fracture toughness decrease, and vice versa.

Due to this inverse relationship between fracture toughness and wear resistance, the grain size of tungsten carbide and the cobalt content can be selected to obtain a desired wear resistance or a desired toughness. For example, a higher cobalt content or a larger WC grains may be used when a higher toughness is required, whereas a lower cobalt content and smaller WC grains are used when a better wear resistance is desired. To achieve a desired balance between wear resistance and toughness, conventionally, grain sizes used for cutting elements have remained within the range of about 1 to 3 μm (as measured by ASTM E-112 method). That is, until recently as disclosed in U.S. application Ser. No. 10/017,404 filed Dec. 14, 2001 and U.S. application Ser. No. 10/396,261 filed Mar. 25, 2003, both titled "Fracture and Wear Resistant Rock Bits," and U.S. application Ser. No. 10/437,750, filed May 14, 2003 and titled "Coarse Carbide Substrate Cutting Elements and Methods of Forming the Same", all incorporated herein reference. As stated therein, there exists a desire and need for improving the toughness of materials used for cutting elements without significantly reducing the wear resistance and, in some cases, thermal conductivity of the resulting cutting element.

SUMMARY OF INVENTION

In one aspect, the present invention relates to a cutting element for a down hole cutting tool which includes a wear resistant material having a binder composition and a coarse grain size such that the wear resistant material has a fracture toughness of at least about 18 ksi(in)$^{0.5}$ and a wear number of at least about 1.8. In one embodiment, the wear resistant material comprises tungsten carbide particles and a cobalt binder composition of between 8% and 16% by weight cobalt, and the fracture toughness is at least about 20 ksi(in)$^{0.5}$.

In one aspect, the present invention relates to a drill bit, which includes a plurality of cutting elements disposed on a cutting structure, wherein at least one of the plurality of cutting elements includes a wear resistant material having a binder composition and a coarse grain size such that the at least one of the plurality of cutting elements has a fracture toughness of at least about 18 ksi (in)$^{0.5}$ and a wear number of at least 1.8. In one embodiment, the wear resistant material comprises tungsten carbide particles and a cobalt binder content of between 8% and 16% by weight cobalt, and the fracture toughness is at least about 20 ksi(in)$^{0.5}$.

In one aspect, the present invention provides a cutting element for a drill bit which includes a wear resistant material having a binder composition and a coarse grain size such that the fracture toughness and the wear number of the wear resistant material general follow the relationship:

$$y=62.085\cdot x^{(-1.3676)},$$

within a range defined by a coefficient of determination, $R^2$, of about 0.86, wherein y is the fracture toughness in ksi(in)$^{0.5}$ and x is the wear number.

Other aspects and advantages of the invention will be apparent from the following description and the appended claims.

BRIEF DESCRIPTION OF DRAWINGS

FIG. 5 shows a table listing the assigned grade name, relative particle size number, cobalt content, and relative hardness obtained for sample coarse grade tungsten carbide composite materials in accordance with example embodiments of the present invention.

DETAILED DESCRIPTION

Figure 1B:
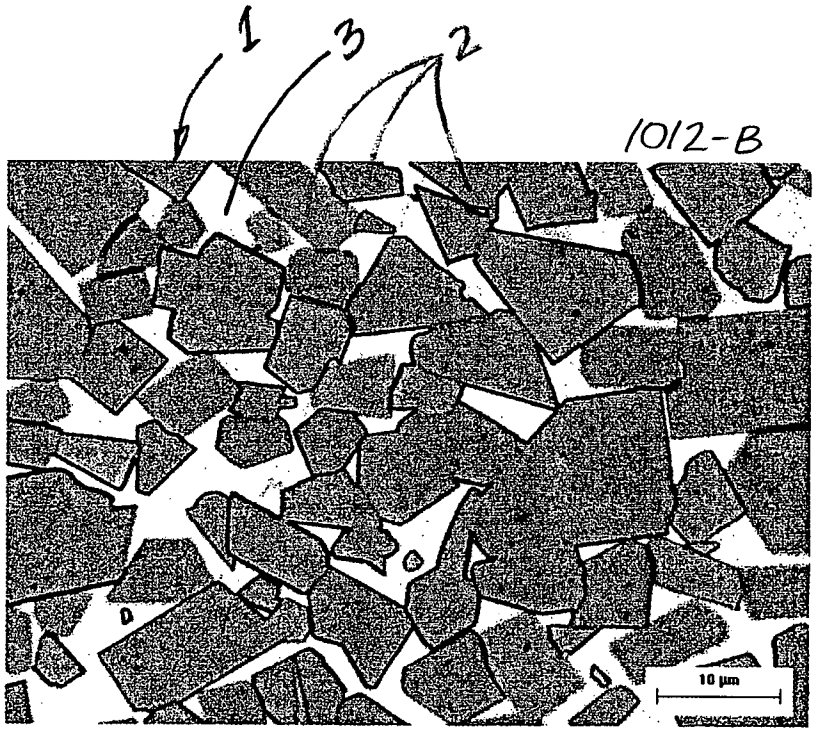
FIGS. 1A and 1B show a micrograph of a coarse grade tungsten carbide composite for a cutting element in accordance with one embodiment of the present invention.

The inventor of the present invention has determined that materials having a higher fracture toughness and sufficient wear resistance can be achieved using coarser grain carbide grades for cutting elements than those used in conventional cutting element applications. Because tungsten carbide disposed in a cobalt matrix is commonly used as a wear resistant material for many cutting element applications, embodiments of the invention are explained herein with reference to a tungsten carbide/cobalt (WC/Co) system. However, it should be understood that the invention is not limited to a WC/Co system. Suitable materials for forming the hard phase particles include transition metal borides, transition metal carbides, and transition metal nitrides. Thus, carbides or borides formed from refractory metals including tungsten (W), titanium (Ti), molybdenum (Mo), niobium (Nb), vanadium (V), hafnium (Hf), tantalum (Ta), chromium (Cr), are specifically considered within the scope of the present invention. Similarly, binder materials considered within the scope of the invention include materials such as cobalt (Co), nickel (Ni), and iron (Fe).

The following naming convention is used to describe embodiments of the invention. Carbide composites are given a three or four digit code name, where the first one or two digits (one if a three digit code, two if a four digit code) indicate the relative (or nominal) particle size of the carbide particles and the last two digits indicate the cobalt content of the composite. For example, "616" represents a carbide composite having a carbide relative particle size number of 6 and 16% cobalt content by weight. Note that the "relative" particle sizes used in this naming convention do not indicate actual particle sizes. For example, an average carbide particle size for a 616 composite, as measured by the ASTM E-112 method, is approximately 2.8 μm. Composite materials having a relative particle size of 6, for example, may be referred to as a "6-series" coarse grade composite.

Now referring to specific embodiments, in one aspect, the present invention provides a fracture and wear resistant composite that has a binder content and an average grain size that provides increased fracture toughness with satisfactory wear resistance compared to conventional composites typically used for cutting element applications. In one aspect, a cutting element for a drill bit comprises wear resistant material having a binder composition and a coarse grain size such that the wear resistant material has a fracture toughness of at least about 18 ksi$(in)^{0.5}$ when measured by the ASTM B-771 method, and a wear number of at least 1.8 when measured by the ASTM B-611 method. In one or more embodiments, the wear resistant material is a composite having a coarse (large) grain size with an average grain size larger than 6 μm (as determined by the ASTM E-112 method). In one or more embodiments, the composite also has a hardness in a range of about 83 to about 86 Rockwell A hardness (Ra). To achieve a particular fracture toughness and wear resistance, the binder content and the grain size of the material should be carefully selected.

Figure 1A:
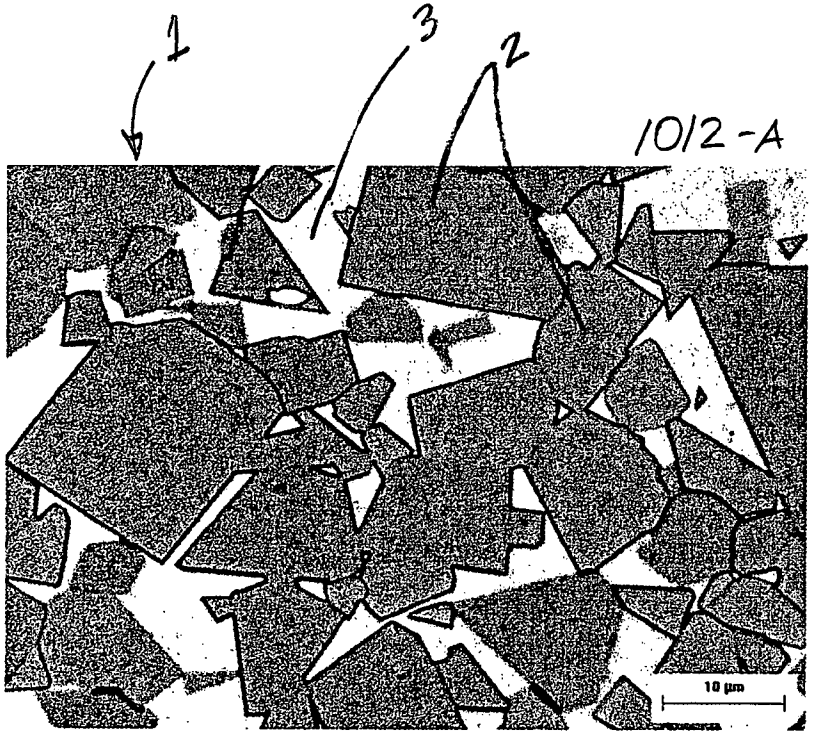

Referring generally to FIG. 1A, cutting elements formed in accordance with one or more embodiments of the present invention have been examined and tested. In these examples, the cutting elements comprise wear resistant material 1 which includes particles of tungsten carbide 2 in a cobalt binder matrix (cobalt 3). Coarse grain tungsten carbide as used in one or more embodiments, can be obtained from companies such as Bruntal (a division of Osram) of the Czech Republic, Woka of Germany, and H.C. Starck of Germany. In general, coarser grain carbides can be used to provide improvements in cutting element fracture toughness while maintaining satisfactory wear resistance for many applications.

Figure 2:
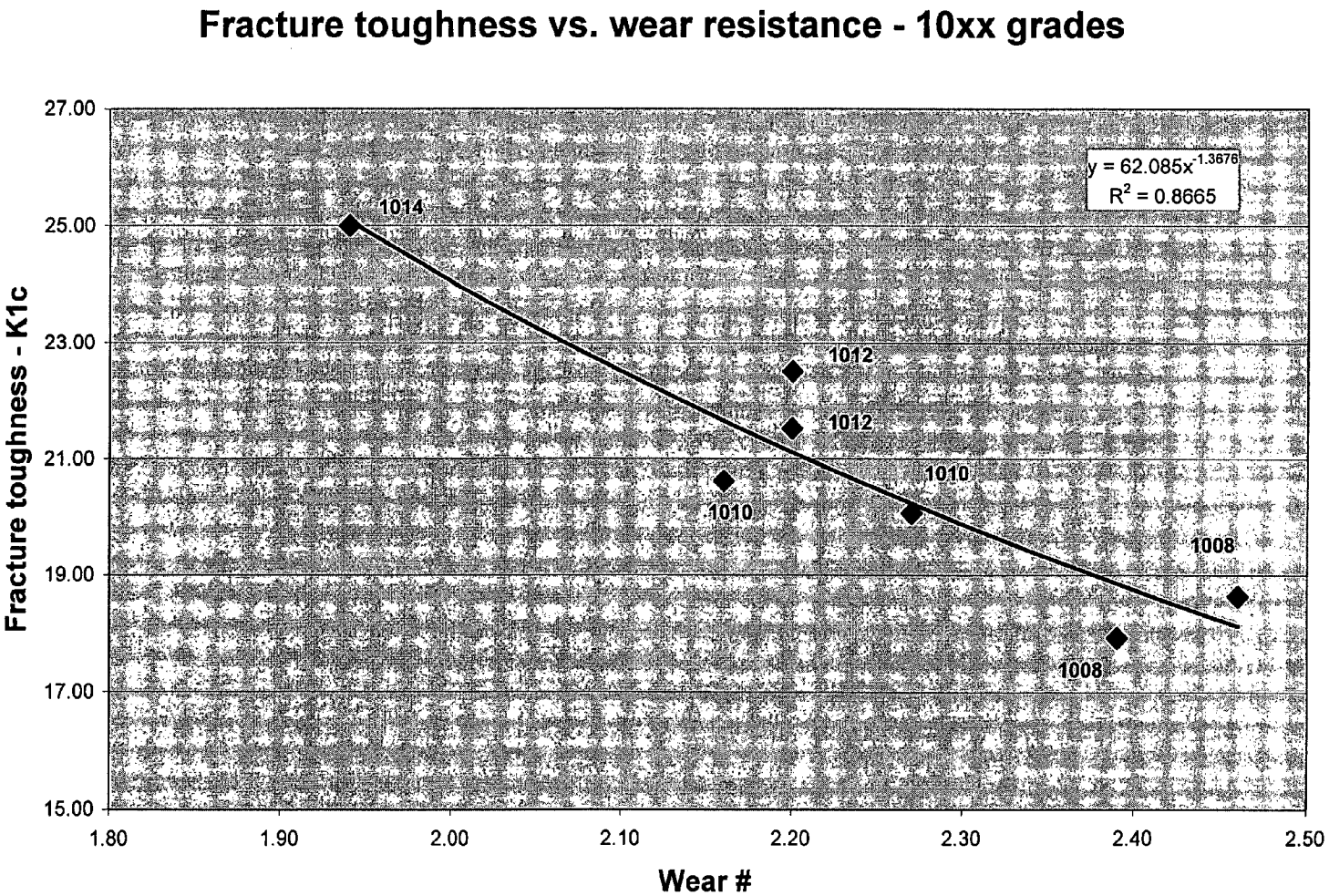
FIG. 2 shows a graphical representation of fracture toughness vs. wear resistance for examples of new coarse grain composites in accordance with embodiments of the present invention.

Referring now to FIG. 2, in one example, cutting elements were formed using a wear resistant material having a cobalt content of about 8% and a carbide relative particle size of 10 (with an average tungsten carbide particle size of around 9 μm). Based on the binder content and the relative grain size, this composition is termed "1008". As shown in FIG. 2, two samples of an 1008 composition exhibited fracture toughness greater or equal to about 18 ksi $(in)^{0.5}$ (as measured in accordance with the ASTM B-771 method), with wear numbers greater than 2.3 (as measured in accordance with the ASTM B-611 method). Specifically, of the two 1008 composite samples shown in FIG. 2, one had a fracture toughness of around 18 ksi $(in)^{0.5}$ and the other had a fracture toughness of around 19 ksi $(in)^{0.5}$. The corresponding wear numbers were between 2.3 and 2.5.

Figure 4:
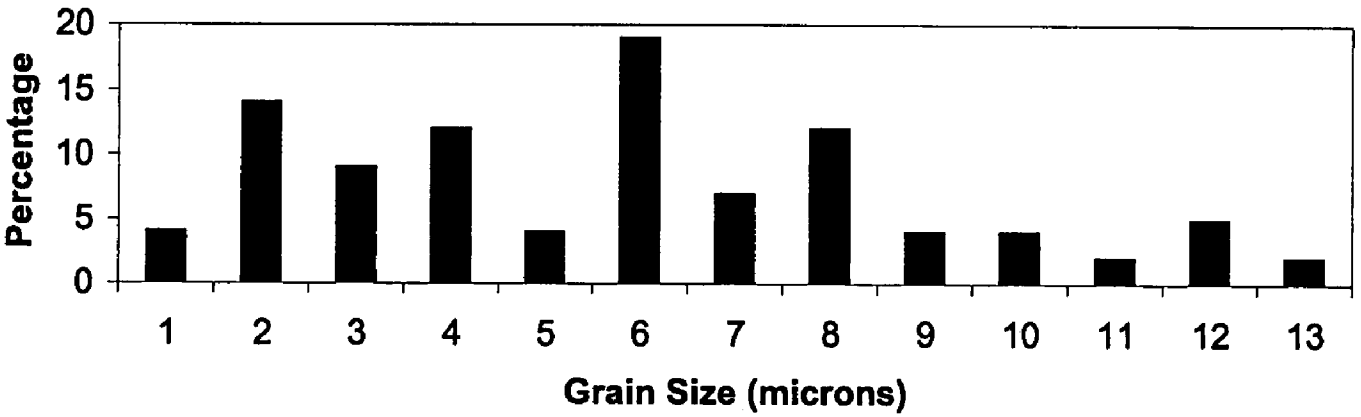
FIG. 4 shows a graphical representation of a grain size distribution for a wear resistant composite material used to form a cutting element of a drill bit in accordance with an embodiment of the present invention.

In another example, cutting elements were formed using a wear resistant material having a cobalt content of about 10% and a tungsten carbide relative particle size of 10. Based on the binder content and grain size, this composition is termed "1010". FIG. 4 shows a graphical representation of the grain size distribution for a sample having a relative particle size of 10. As summarized in the upper right corner of the figure, the average tungsten carbide particle size as measured by ASTM E-112 method is approximately 9.2 μm, with a minimum particle size of 2.7 μm and a maximum particle size of 20 μm.

As shown in FIG. 2, example 1010 compositions exhibited fracture toughness greater than or equal to about 20 ksi $(in)^{0.5}$ (as measured in accordance with the ASTM B-771 method) and wear numbers greater than or equal to about 2.1 (as measured in accordance with the ASTM B-611 method). Specifically, of the two 1010 composite samples shown in FIG. 2, one had a fracture toughness of around 20 ksi $(in)^{0.5}$ and the other had a fracture toughness of between 20 ksi $(in)^{0.5}$ and 21 ksi $(in)^{0.5}$. The wear numbers are between 2.1 and 2.3.

In another example, cutting elements were formed using a wear resistant material comprising tungsten carbide particles and a cobalt binder. The cobalt content was about 12% and the tungsten carbide relative particle size was about 10. Based on the binder content and grain size, this composition is termed "1012". Micrographs of two 1012 compositions are shown in FIGS. 1A and 1B. The average particle size for these samples is around 9 μm, (i.e., between 8 and 10 μm). As shown in FIG. 2, 1012 compositions exhibited fracture toughness greater than 21 ksi $(in)^{0.5}$ (as measured in accordance with the ASTM B-771 method) and wear numbers greater than about 2.0 (as measured in accordance with the ASTM B-611 method). Specifically, the two 1012 composite samples shown in FIG. 2 had fracture toughness of between 21 ksi $(in)^{0.5}$ and 23 ksi $(in)^{0.5}$, with wear numbers around 2.2. Based on this and similar samples considered, 1012 compositions are expected to typically result in fracture toughness of greater than 21 ksi $(in)^{0.5}$ and wear numbers greater than 2.0.

Figure 3B:
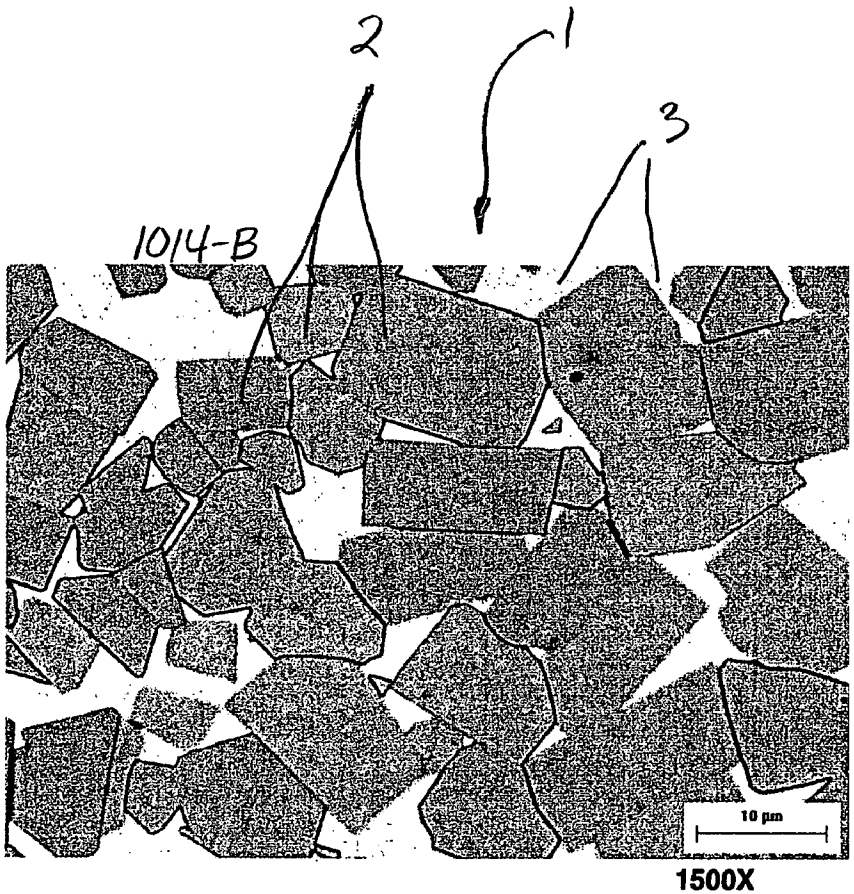
FIGS. 3A and 3B show a micrograph of another coarse grade tungsten carbide for a cutting element in accordance with an embodiment of the present invention.
Figure 3A:
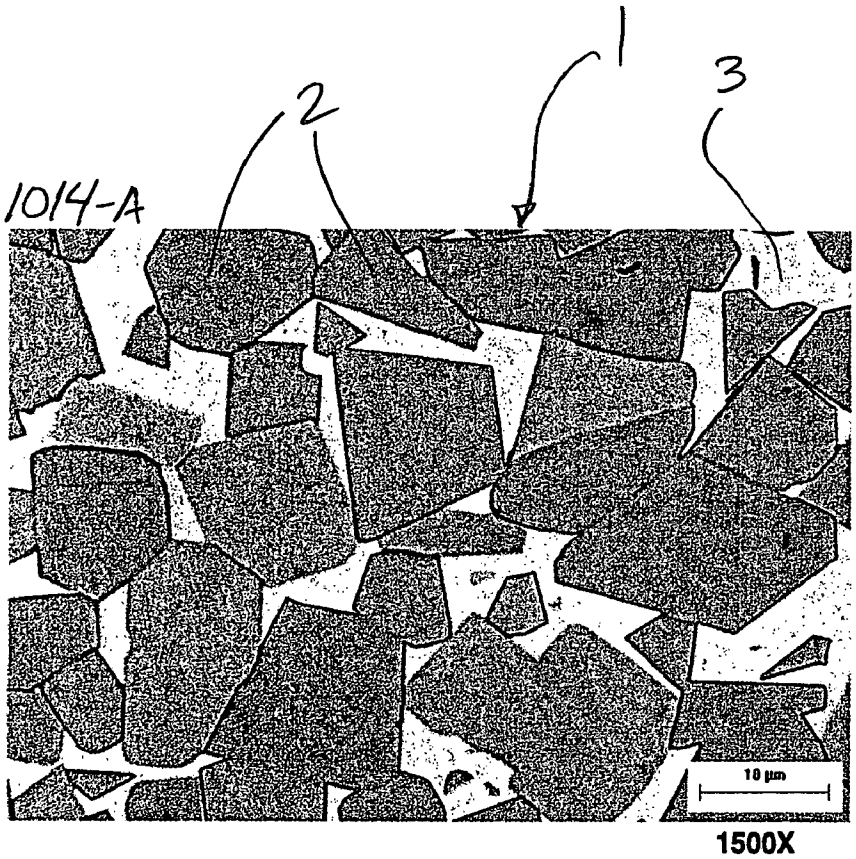

In another example, cutting elements having a cobalt content of about 14% and a carbide relative particle size of about 10 were made. Based on the binder content and grain size used, this composition is termed "1014". Micrographs of two 1014 samples are shown in FIGS. 3A and 3B. The average tungsten carbide particle size is around 9 μm. As shown in FIG. 2, a sample of the 1014 composition exhibited fracture toughness around 25 ksi$(in)^{0.5}$ (as measured in accordance with the ASTM B-771 method), with a wear number greater than 1.9 (as measured in accordance with the ASTM B-611 method).

Based on these examples and examples previously presented in related applications, it is expected that wear resistant materials with average particle sizes greater than 6 μm and carbide contents of between about 8% and 16% will result in fracture toughness greater than or equal to 18 ksi $(in)^{0.5}$ and wear numbers greater than or equal 1.8.

Samples shown in FIG. 2 were also examined to determine their hardness.

The hardnesses for these and related composites are shown in FIG. 5. Referring to FIG. 5, for a relative grain size of 10, composites containing about 6% by weight cobalt had an average hardness of around 86.2. Composites containing about 8% by weight cobalt had an average hardness of around 85.6. Composites containing about 10% by weight cobalt had an average hardness of around 85.0. Composites containing about 12% by weight cobalt had an average hardness of around 84.4. Composites containing about 14% by weight cobalt had an average hardness of around 83.8. Composites containing about 16% by weight cobalt had an average hardness of around 83.2.

Wear resistant composites as described above can be used to form cutting elements having increased toughness with sufficient wear resistance. For example, in one or more embodiments, a wear resistant composite may be used to form an insert, such as for a roller cone drill bit or any other down hole drilling tool. In on or more other embodiments, the wear resistant composite forms a substrate for a shear cutter which has a layer of ultra-hard material bonded to a surface thereof. Cutting elements having a fracture and wear resistant bodies in accordance with aspects of the invention may have increased toughness and sufficient wear resistance compared to cutting elements formed using conventional composites.

Figure 6:
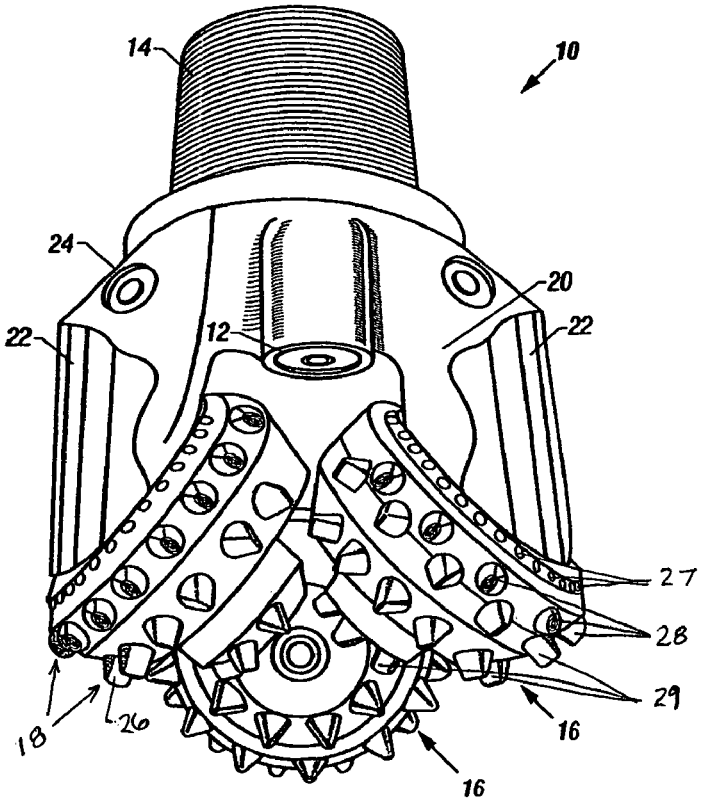
FIG. 6 shows a perspective view of a roller cone drill bit in accordance with an embodiment of the present invention.

One embodiment of a roller cone drill bit is shown in FIG. 6, the drill bit 10 includes a bit body 20 having threads 14 formed at an upper end. The threads 14 are adapted to couple the bit 10 to a drill string assembly (not shown) for positioning the drill bit 10 in a wellbore. The bit body 20 also includes three legs 22 which extend at a lower end of the bit body 20. Each leg has a cantilevered journal (not shown). A roller cone 16 is rotatably mounted on the journal of each of the legs 22 proximal the lower end of the bit body 20. A plurality of cutting elements 18 is disposed on each roller cone 16. The cutting elements 18 may be integrally formed with, press-fit (or interference fit), brazed, or otherwise affixed in holes (not shown) formed in the roller cones 16.

As shown in FIG. 6, the cutting elements 18 may be generally arranged in concentric rows about the surface of the cones 16. In such case, the rows typically include a heel row made up of heel row inserts 27, a gage row made up of gage row inserts 28, and interior rows made up of interior row inserts 29. The inserts may be substantially equally spaced about the circumference of their row. The heel row inserts 27 and the gage row inserts 28 usually act together to drill a gage diameter of the borehole. The interior row inserts 29 generally act to crush and chip earth formation being drilled. The geometric shape of the inserts is not critical for the invention; however, in some embodiments the inserts may have a semi-round top, a conical top, and/or a chisel-shaped top geometric shape.

Figure 7:
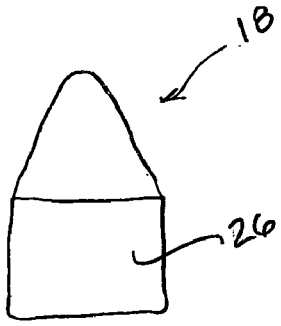
FIG. 7 shows an insert in accordance with an embodiment of the present invention.

In accordance with an embodiment of the present invention, at least one of the cutting elements 18 comprises an insert 26 having a body formed of a wear resistant material as described herein. An enlarged view of a cutting element 18 comprising an insert 26 in accordance with one or more embodiments of the present invention is shown for example in FIG. 7. In accordance with embodiments of the invention, the insert may be disposed on a gage row and/or an inner row of one or more roller cones of a roller cone drill bit.

Figure 8:
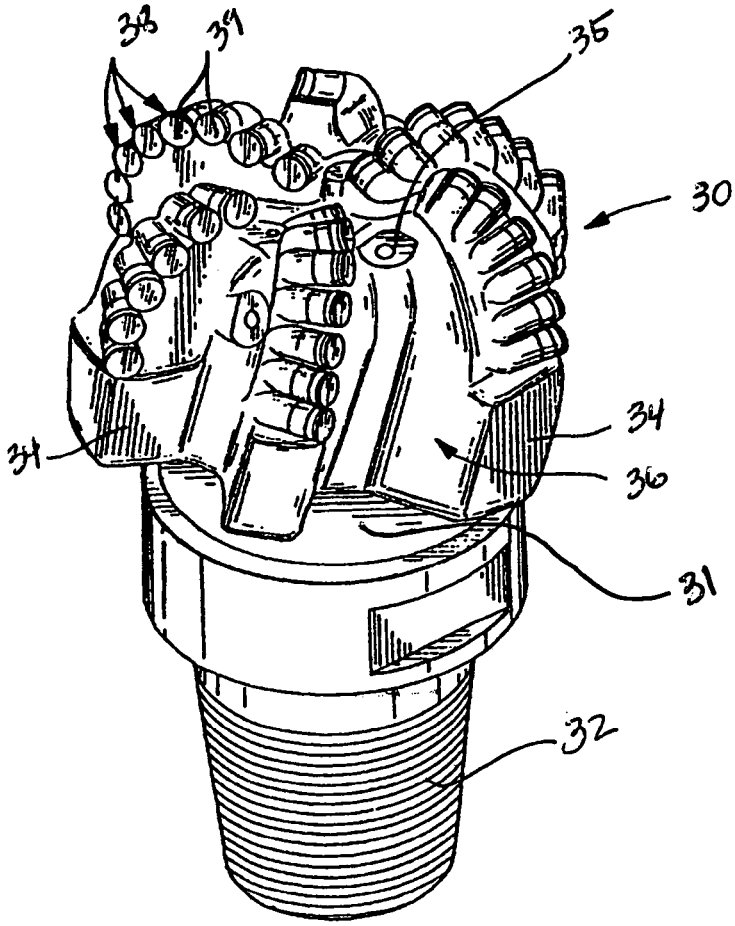
FIG. 8 shows a perspective view of a fixed cutter drill bit in accordance with an embodiment of the present invention.

FIG. 8 shows one example of a fixed cutter bit 30 for drilling subterranean formations. The drill bit 30 includes a bit body 31 having threads 32 formed at an upper end which are adapted to couple the bit 30 to a drill string assembly (not shown) for positioning the drill bit 30 in a wellbore. The bit body 31 also includes a plurality of radially extending blades 34 that extend from a head 36 of the drill bit 30. A plurality of cutting elements 38 is disposed on each of the blades 34. The cutting elements 38 are typically press-fit, brazed, or otherwise affixed in holes (not shown) formed in the blades 34. The cutting elements 38 in this example comprise shear cutters 39, which include a substrate formed of a wear resistant material and a layer of polycrystalline diamond (PCD) or diamond-like material bonded thereto.

Figure 9:
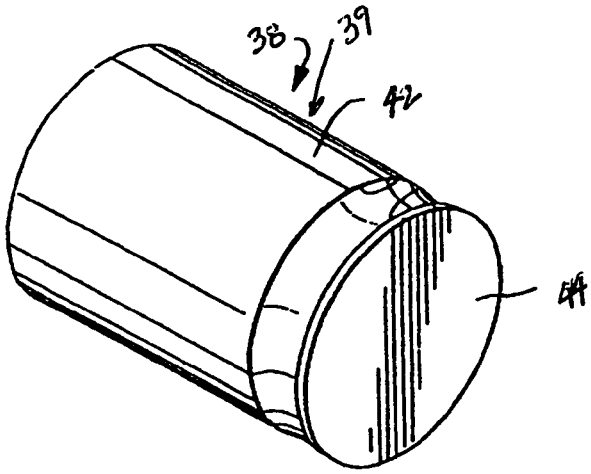
FIG. 9 shows a shear cutter in accordance with an embodiment of the present invention.

In accordance with an embodiment of the present invention, at least one of the cutting elements 38 comprises a shear cutter 39 having a substrate formed of a wear resistant material, as described herein. An enlarged view of a cutting element 38 comprising a shear cutter 39 in accordance with an embodiment of the present invention is shown, for example, in FIG. 9.

In general, when a drill bit is used in the course of drilling, the drill bit is typically threaded onto a lower end of a drill string assembly (not shown) and lowered into a borehole. Once the bit is positioned at the bottom of the borehole, the drill string is rotated by, for example, a rig rotary table or a top drive under an applied weight on bit (WOB), and the cutting elements on the bit are forced to engage with formation at the bottom and side of the borehole to scrape, crush and/or chip formation as the bit is rotated. Drilling fluid (often referred to as "drilling mud") is usually pumped through the drill string and drill bit body and ejected from nozzles (12 in FIG. 6, 35 in FIG. 8) disposed in the bit body. Drilling fluid pumped through the bit is forced up the annulus between the drill string and the borehole wall and transports formation cuttings drilled by the bit from the bottom of the borehole to the surface. The drilling fluid also serves to cool and clean the cutting elements 18 and bit as the borehole is drilled.

In another aspect, the invention provides a down hole cutting tool comprising a plurality of cutting elements mounted on a cutting structure, wherein at least one of the cutting elements is formed from a wear resistant material having a binder composition and a coarse grain size such that the portion of the cutting element formed of the wear resistant material has a fracture toughness of at least about 18 ksi $(in)^{0.5}$ and a wear number of at least 1.8. The cutting tool may comprise a drill bit, reamer, stabilizer, milling tool, hole opener, or similar tool. In one or more embodiments, the wear resistant material may comprise between 8% and 16% cobalt as a binder. In one or more embodiments, the wear resistant material comprises tungsten carbide particles dispersed in a cobalt binder matrix. In a particular embodiment, the tungsten carbide particles have a relative grain size greater than or equal to 10 (which corresponds to an average grain size of around 9 μm or more) and the wear resistant material has a cobalt content of between about 10% and 14% to provide a fracture toughness in the range of about 20 ksi $(in)^{0.5}$ to about 27 ksi $(in)^{0.5}$, with a wear number between about 1.9 to about 2.3. In one or more embodiments, the wear resistant material also has a hardness in a range of about 83 to about 86 Rockwell A. Also, in one or more embodiments, and entire cutting element, such as in insert for a drill bit, has a body formed of the wear resistant material described above.

In the case of a tool comprising a drill bit, the bit may also include a bit body, wherein the cutting structure is coupled to or formed on the bit body. In the case of a roller cone drill bit, the cutting structure comprises at least one roller cone rotatably coupled to the bit body with cutting elements mounted thereon. In the case of a fixed cutter bit, the bit may comprises a bit body having radially extending blades disposed at an end of the bit body, with at least one cutting element in accordance with the description above disposed on at least one of the blades.

Figure 10:
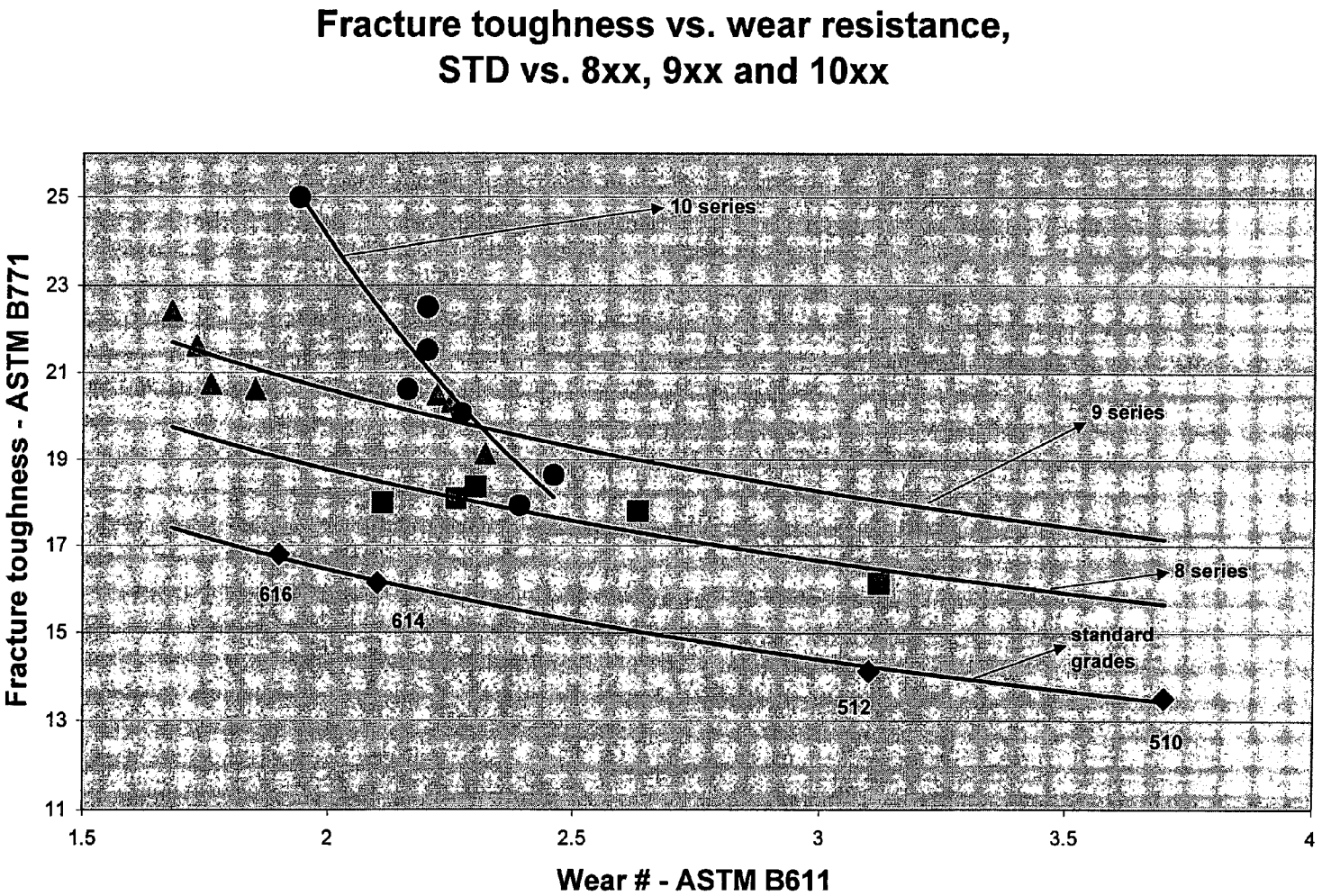
FIG. 10 shows a graphical comparison of fracture toughness vs. wear resistance for some conventional carbide composites and new carbide composites that relate to embodiments of the present invention.
Figure 11A:
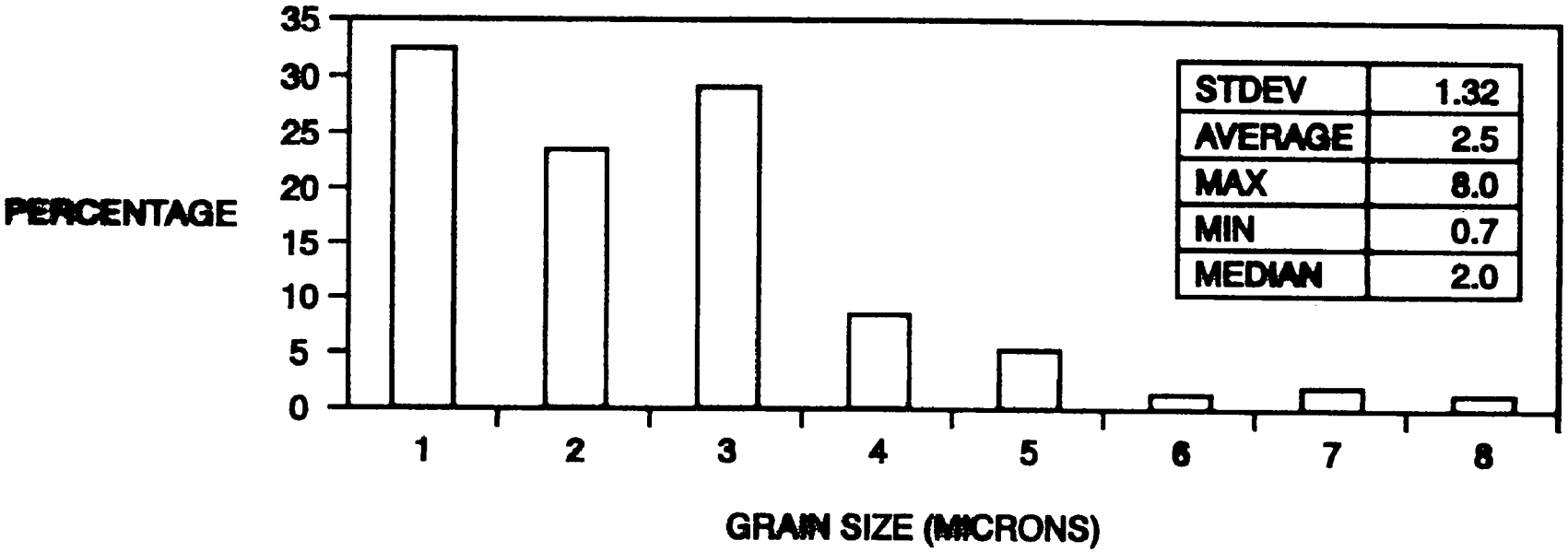
FIGS. 11A and 11B show graphical representations of the grain size distribution for conventional "510" and "616" compositions, respectively.
Figure 11B:
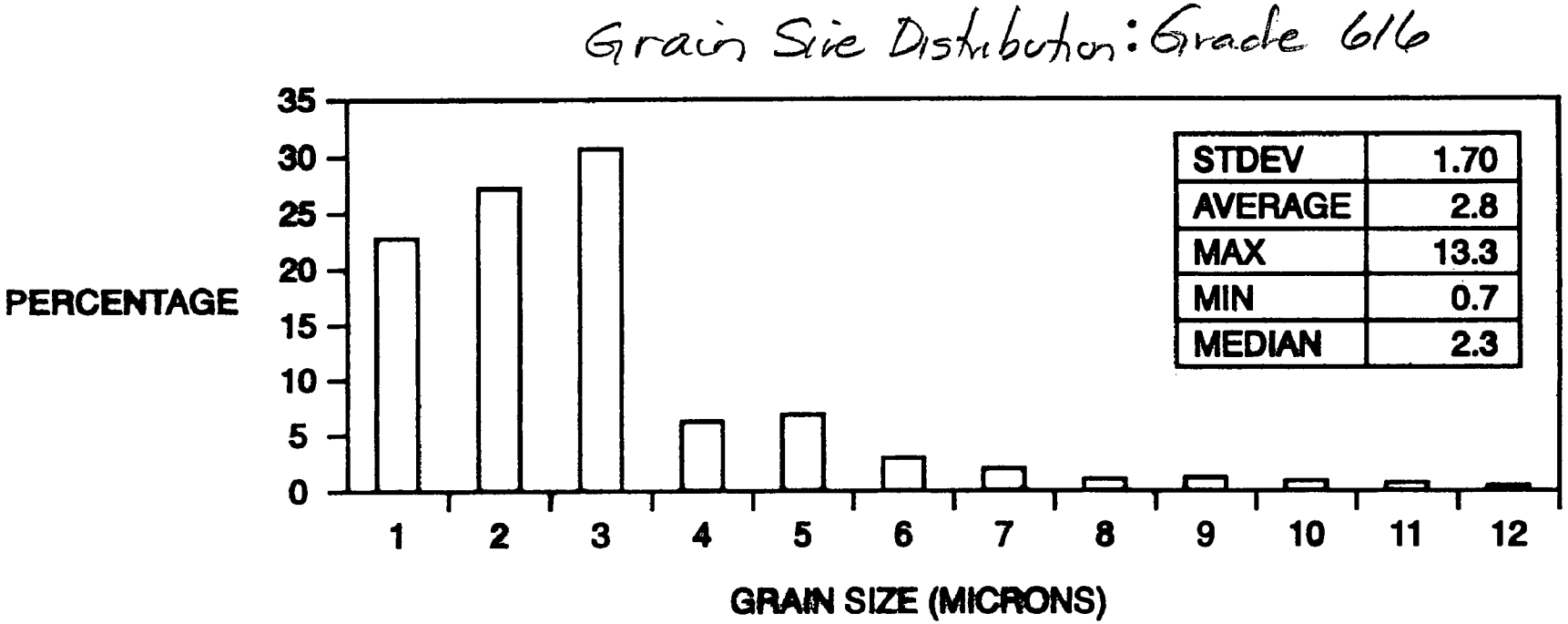

A comparison of wear resistant composites having coarse grains versus standard size grains is shown in FIG. 10. Exemplary grain size distributions for standard compositions "510" and "616" and other coarse grain compositions "812" and "916" are shown in FIGS. 11A, 11B, 12A, and 12B, respectively. Like the 10-series materials, all of the compounds have a distribution of grain sizes. The average grain size for each of the examples presented is listed under the heading "average" in the figures, generally in the upper right corner.

Conventional carbide grades generally use carbides having a relative particle size number of about 3 to about 6 and cobalt contents of 6% to 16% by weight. The average carbide particle size for these conventional carbides, as measured by the ASTM E-112 method, is less than 3.0 μm, as shown for the conventional (standard grade) carbide inserts, 510 and 616, in FIGS. 11A and 11B.

Figure 12A:
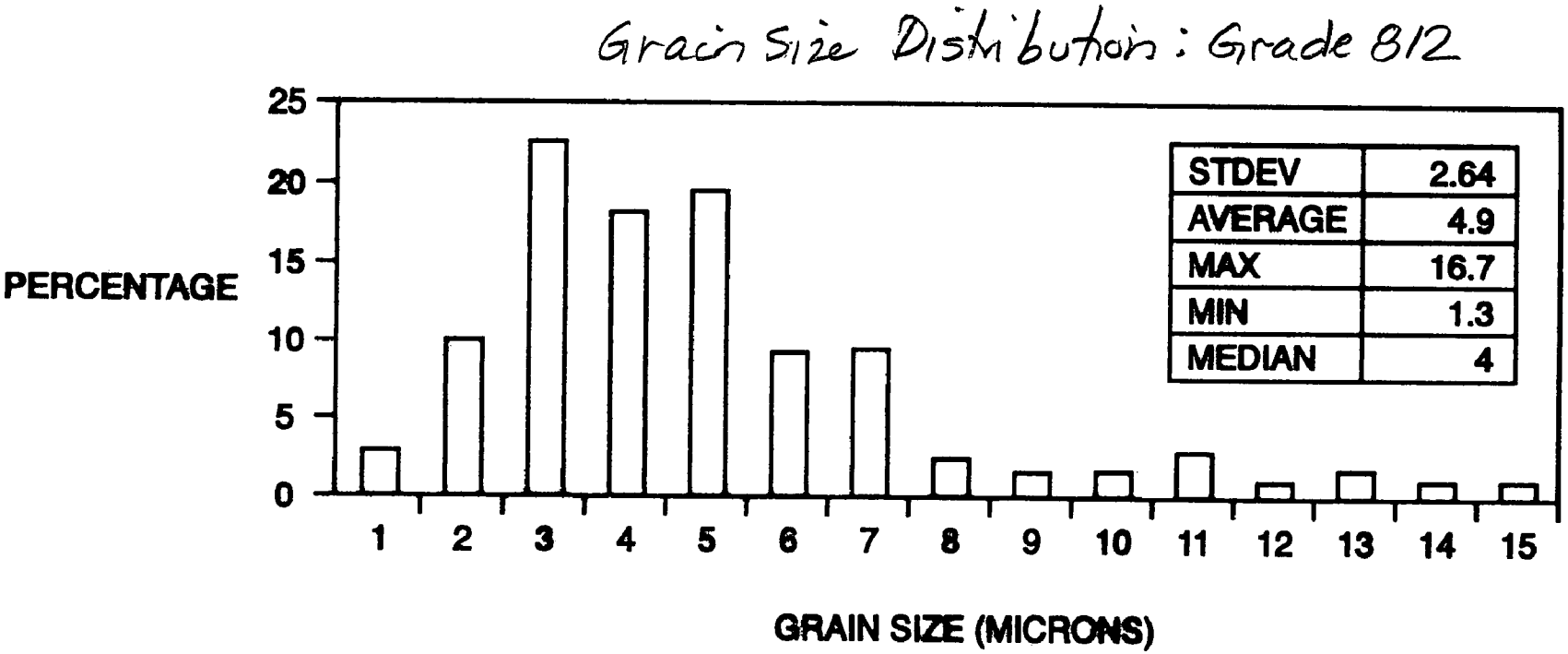
FIGS. 12A and 12B show example graphical representations of the grain size distributions for a "8 series" composition and a "9 series" composition, which relate to embodiments of the present invention and are covered in related applications incorporated herein by reference.
Figure 12B:
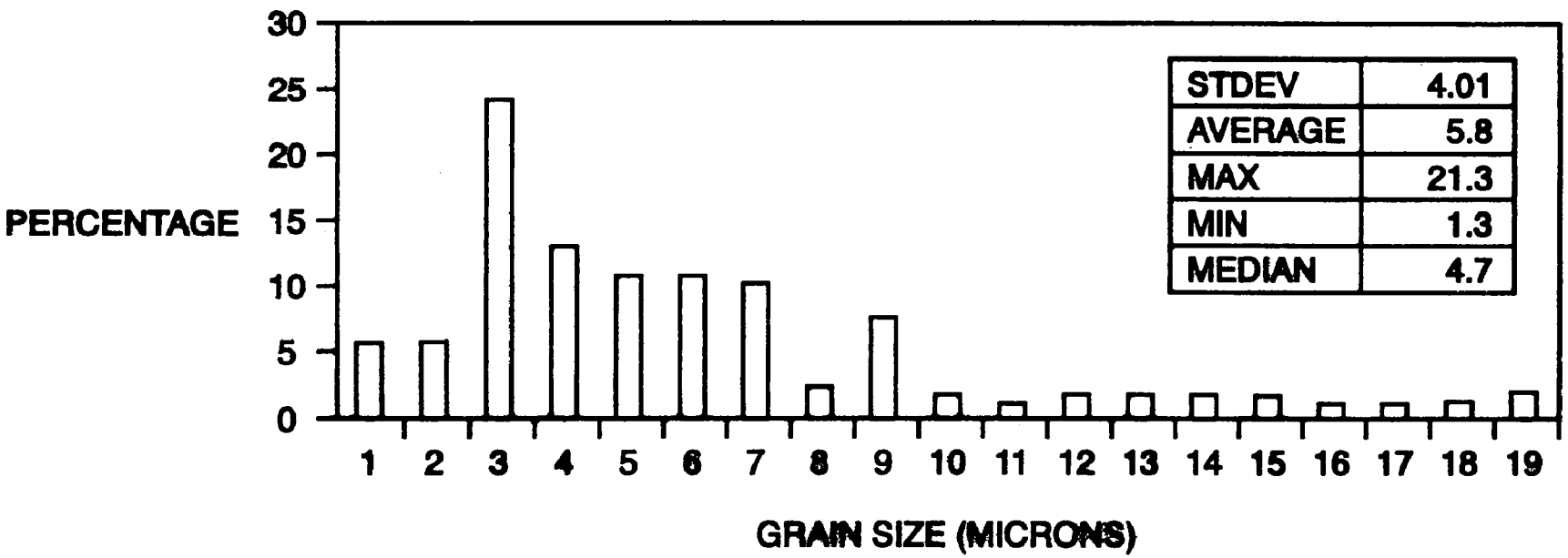

Coarse grain carbides as disclosed herein and presented in related applications incorporated herein by reference have relative particle sizes greater than 6 (average particle sizes greater than 3 μm), and binder contents of 6% to 16% by weight. As shown in FIG. 12A, one sample of an 812 composite (which has a relative particle size of 8 and a cobalt binder content of about 12%) was shown to have an average particle size of 4.9 μm. As shown in FIG. 12B, one sample of a 916 composite (which has a relative particle size of 9 and a cobalt binder content of about 16%) was shown to have an average particle size of 5.8 μm.

In FIG. 10, the fracture toughness and wear resistance of standard carbide grades (e.g., 510, 512, 614, 616, 512 indicated by diamonds) graphically compared to examples of the improved compounds, such as the 8-series composites (e.g., 808, 810, 812, 814 indicated by squares) and 9-series composites (e.g., 910, 912, 914, 916 indicated by triangles), and the 10-series composites (e.g., 1008, 1010, 1012, 1014 indicated by circles). The coarser grain composites have been shown to result in improved toughness while maintaining sufficient wear resistance for many applications. It should be understood that the invention is not limited to the example series shown herein, but rather, in general, is expected to include even coarser (larger) grain size composites which are expected to yield improved characteristics that fall within the scope of the invention as set forth in the claims.

Referring now to FIG. 10, curves 80, 81, 82, and 83 have been plotted through the various series of carbides discussed above to show the general trend of various conventional and novel material grades that may be used for inserts, or, in the case of shear cutters, as substrate material. As can be seen from the curves, prior to the discovery of the present invention, it was believed that increasing fracture toughness could only be achieved with a corresponding loss of wear resistance. In contrast, the trend exhibited by embodiments of the present invention show that both fracture toughness and wear resistance can be increased by using coarser grain carbides and by selectively controlling the binder content in the resulting material. The new embodiments disclose herein are further evidence of the fact that improved cutting elements can be obtained using coarser grain carbide particles within the selected range of 6% to 16% binder material. Wherein in the case of cobalt, the cobalt content can be selected within around this range to obtain a cutting element (in whole or in part) having improved fracture toughness and satisfactory wear resistance for a given application.

A comparison of normalized thermal fatigue resistance index between conventional carbide inserts and the coarse grain carbide of the present invention has previously been shown to result in increased thermal fatigue resistance for the coarser grain carbides as compared to conventional carbide composites. Increased thermal fatigue is also expected with coarser grain carbides. In particular, it has been previously disclosed that larger carbide grains coupled with less cobalt contact gives better thermal fatigue resistance. Past data has indicated that larger carbide grains increases thermal conductivity and lower cobalt binder content reduces the coefficient of thermal expansion (CTE). Thus, in general, higher thermal conductivity coupled with lower CTE is expected to lead to increase in thermal fatigue resistance.

Control over particle size and cobalt content, therefore, provide a measure of control over the toughness and wear resistance of a particular insert or substrate material. Accordingly, drill bits, including roller cone drill bits and fixed cutter bits, may be designed so that inserts having desired properties are selectively positioned on the bit. This may be especially beneficial in roller cone bit applications because often times in some bit designs or applications, it may be desirable to position inserts having different toughness and wear resistance properties on different rows. For example, in some embodiments, inserts positioned on interior rows may have a higher toughness and/or wear resistance than inserts positioned on gage rows. However, other cutting element arrangements are within the scope of the invention, and these particular embodiments are not intended to be limiting.

In other embodiments, the wear resistant material has a relative coarse grain size greater than 10. Using coarse grain sizes larger than a relative grain size of 10, such as those classified as relative grain sizes of 11, 12, 13, etc., is also expected to provide advantageous wear resistant materials having wear numbers greater than 1.8 and fracture toughness of greater than 18 ksi $(in)^{0.5}$.

Referring to FIG. 2, in another aspect, 10-series composites may be generally described in terms of a relationship between fracture toughness and wear resistance, such as by an equation approximating the best-fit curve through the examples shown. Accordingly, in another aspect, particular embodiments of the invention may be described as comprising a wear resistant material having a fracture toughness and wear number relationship that general follows the relationship:

$$y=62.085\cdot x(-1.3676)$$

wherein y is the fracture toughness $(ksi(in)^{0.5})$ and x is the wear number. The fracture toughness and wear number are considered to follow this relationship when their values are within a range defined by a coefficient of determination, $R^2$, of 0.86 (wherein R is the correlation coefficient).

In one or more embodiments, the wear resistant material also comprises a hardness in a range of about 83 to 86 Rockwell A. In one or more embodiments, the wear resistant material comprises tungsten carbide particles disposed in a cobalt matrix, wherein the wear resistant material comprises between about 6% and about 16% by weight cobalt. In particular embodiments, the wear resistant material may have between about 10% and about 14% by weight cobalt. In one or more embodiments, the tungsten carbide particles may have an average coarse grain particle size of around 9 micrometers or more. In one or more embodiments, the wear resistant material may also have a fracture toughness in the range of about 18 ksi (in)0.5 to about 27 ksi (in)0.5.

In one or more embodiments, a down hole cutting tool is provided having a cutting element formed of a wear resistant composite material in accordance with this aspect. The cutting tool may comprise a drill bit, in which case, the drill bit may comprise a roller cone drill bit or a fixed cutter drill bit as previously described.

In general, carbide composites in accordance with above descriptions can be used in a number of different applications, such as tools for mining and construction applications where mechanical properties of high fracture toughness, wear resistance, and hardness are highly desired. Carbide composites in accordance with one or more embodiments of the present invention can be used to form wear and cutting components in such tools a roller cone bits, percussion or hammer bits, drag bits, and a number of different cutting and machine tools.

The one or more embodiments of the present invention also provide a method for improving the fracture toughness and wear resistance of composite materials used for cutting elements by using coarser grain carbides, in particular, carbides having relative grain sizes greater than 6 (or average grain sizes greater than 3 μm). Because of the improved benefits provided by one or more embodiments of the invention, cutting elements and bits made in accordance with aspects of the present invention may advantageously last longer, result in fewer trips required to change bits during drilling, and/or reduce the amount of rig down time, which may result in a significant cost saving during drilling. These and other advantages may be realized in one or more embodiments by selecting coarse carbide grain sizes and cobalt contents as described herein.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A cutting element for a rock bit used to drill wellbores through earth formation, the cutting element comprising:

wear resistant material, the wear resistant material comprising coarse grains disposed in a binder matrix; the coarse grains comprising grains of at least one selected from the group of a transition metal carbide, a transition metal boride, and transition metal nitride, the wear resistant material having a binder composition and a coarse grain size such that the wear resistant material has a fracture toughness of at least 20 ksi $(in)^{0.5}$ and a wear number of at least 1.8.

2. The cutting element of claim 1, wherein the fracture toughness is at least about 21 ksi $(in)^{0.5}$.

3. The cutting element of claim 1, wherein the fracture toughness is between 20 ksi $(in)^{0.5}$ and 27 ksi $(in)^{0.5}$.

4. The cutting element of claim 1, wherein the grains comprise tungsten carbide particles and the binder material comprises cobalt, and wherein the wear resistant material comprises between about 10% and about 16% by weight cobalt.

5. The cutting element of claim 4, wherein the wear number is between about 1.8 and about 2.5.

6. The cutting element of claim 4, wherein the wear resistant material comprises between 12% and 16% by weight cobalt.

7. The cutting element of claim 6, wherein the wear number is between about 1.9 and about 2.3.

8. The cutting element, of claim 1, wherein the wear resistant material has a hardness in a range of about 83 to about 86 Rockwell A.

9. A drill bit for drilling wellbores through earth formation, the drill bit comprising:

a plurality of cutting elements mounted on a cutting structure, wherein at least one of the plurality of cutting elements comprises a wear resistant material, the wear resistant material comprising coarse grains disposed in a binder matrix, the coarse grains comprising grains of at least one selected from the group of a transition metal carbide, a transition metal boride, and transition metal nitride, the wear resistant material having a binder composition and a coarse grain size such that the wear resistant material has a fracture toughness of at least 20 ksi $(in)^{0.5}$ and a wear number of at least 1.8.

10. The drill bit of claim 9, wherein the fracture toughness is at least about 21 ksi $(in)^{0.5}$.

11. The drill bit of claim 9, wherein the fracture toughness is between 20 ksi $(in)^{0.5}$ and 27 ksi $(in)^{0.5}$.

12. The drill bit of claim 9, wherein the grains comprise tungsten carbide particles and the binder material comprises cobalt, and wherein the wear resistant material comprises between about 10% and about 16% by weight cobalt.

13. The drill bit of claim 12, wherein the wear number is between about 1.8 and about 2.5.

14. The drill bit of claim 12, wherein the wear resistant material comprises between 12% and 16% by weight cobalt.

15. The drill bit of claim 14, wherein the wear number is between about 1.9 and about 2.3.

16. The drill bit of claim 9, wherein the wear resistant material has a hardness in a range of about 83 to about 86 Rockwell A.

17. The drill bit of claim 9, wherein the drill bit has a bit body, and the cutting structure comprises at least one roller cone rotatably coupled to the bit body, and the at least one of the plurality of cutting elements is disposed on the at least one roller cone.

18. The drill bit of claim 9, wherein the drill bit has a bit body, and the cutting structure comprises a plurality of radially extending blades disposed at one end of the bit body, and the at least one cutting element is disposed on at least one of the blades.

19. A cutting element for a rock bit used to drill wellbores through earth formation, the cutting element, comprising:

wear resistant material, the wear resistant material comprising coarse grains disposed in a binder matrix, the coarse grains comprising grains of at least one selected from the group of a transition metal carbide, a transition metal boride, and transition metal nitride, the wear resistant material having a binder composition and a coarse grain size such that the fracture toughness and the wear number of the wear resistant material generally follow the relationship:

$$y=62.085\cdot x^{(-1.3676)}$$

wherein y is the fracture toughness which is greater than or equal to 20 ksi $(in)^{0.5}$, and x is the wear number, within a range defined by a coefficient of determination, $R^2$, of about 0.86.

20. The cutting element of claim 19, wherein the wear resistant material has a fracture toughness in the range of 20 ksi $(in)^{0.5}$ to about 27 ksi $(in)^{0.5}$.

21. The cutting element of claim 19, wherein the wear resistant material also has a hardness of between about 83 to about 86 Rockwell A.

22. The cutting element of claim 19, wherein the binder composition comprises a cobalt content of between about 10% and about 16% by weight cobalt.

23. A drill, bit for drilling wellbores through earth formation, the drill bit; comprising:

a plurality of cutting elements mounted on a cutting structure, wherein at least one of the plurality of cutting elements is formed from wear resistant material, the wear resistant material comprising coarse grains disposed in a binder matrix, the coarse grains comprising grains of at least one selected from the group of a transition metal carbide, a transition metal boride, and transition metal nitride, the wear resistant material having a binder composition and a coarse grain size such that the fracture toughness and the wear number generally satisfy the relationship:

$$y=62.085\cdot x^{(-1.3676)},$$

wherein y is the fracture toughness which is greater than or equal to 20 ksi $(in)^{0.5}$, and x is the wear number, within a range defined by a coefficient of determination, $R^2$, of about 0.86.

24. The drill bit of claim 23, wherein the wear resistant material has a fracture toughness in the range of 20 ksi $(in)^{0.5}$ to about 27 ksi $(in)^{0.5}$.

25. The drill bit of claim 23, wherein the wear resistant material has a hardness of between about 83 to about 86 Rockwell A.

26. The drill bit of claim 23, wherein the wear resistant material has the binder composition of between about 10% and about 16% by weight cobalt.

27. The drill bit of claim 23, wherein the cutting tool comprises a drill bit including a bit body, wherein the cutting structure comprises at least one roller cone rotatably coupled to the bit body, and the at least one cutting element is disposed on the at least one roller cone.

28. The drill bit of claim 23, wherein the cutting tool comprises a drill bit including a bit body, and the cutting structure comprises a plurality of radially extending blades disposed on an end of the bit body, and the at least one cutting element is disposed on at least one of the blades.

29. The cutting element of claim 1, wherein the wear resistant material comprises coarse grains having an average grain size of greater than 6 μm.

30. The cutting element of claim 29, wherein the wear resistant material comprises coarse grains having an average grain size of around 9 μm or more.

31. The drill bit of claim 9, wherein the wear resistant material comprises coarse grains having an average grain size of greater than 6 μm.

32. The drill bit of claim 31, wherein the wear resistant material comprises coarse grains having an average grain size of around 9 μm or more.

33. A drill bit used to drill wellbores through earth formation, the drill bit comprising:

a plurality of cutting elements mounted on a cutting structure, wherein at least one of the plurality of cutting elements is formed of a wear resistant material comprising coarse grains of tungsten carbide disposed in a cobalt binder matrix, the tungsten carbide grains having an average grain size of around 9 μm, and the wear resistant material having a cobalt binder content of between about 10% and about 16% by weight.

34. The drill bit of claim 33, wherein the drill bit further comprises a bit body, and the cutting structure comprises at least one roller cone rotatably coupled to the bit body, and the at least one cutting element is disposed on the at least one roller cone.

35. The drill bit of claim 34, wherein the at least one roller cone comprises three roller cones, and a plurality of cutting elements disposed on each of said roller cones is formed entirely of said wear resistant material.

36. The drill bit of claim 34, wherein said at least one cutting element is disposed on a gage row of said at least one roller cone.

37. The drill bit of claim 34, wherein the wear resistant material has a cobalt binder content of between about 12% and about 16% by weight.

* * * * *